US010590705B2

(12) United States Patent
Sheehan et al.

(10) Patent No.: US 10,590,705 B2
(45) Date of Patent: Mar. 17, 2020

(54) IMPACT-DRIVEN DOWNHOLE MOTORS

(71) Applicant: DRECO ENERGY SERVICES ULC, Edmonton, Alberta (CA)

(72) Inventors: Mark Sheehan, Edmonton (CA); Jonathan Prill, Edmonton (CA)

(73) Assignee: Dreco Energy Services ULC (CA)

( * ) Notice: Subject to any disclaimer, the term of this patent is extended or adjusted under 35 U.S.C. 154(b) by 240 days.

(21) Appl. No.: 15/561,468

(22) PCT Filed: Mar. 24, 2016

(86) PCT No.: PCT/CA2016/000082

§ 371 (c)(1),
(2) Date: Sep. 25, 2017

(87) PCT Pub. No.: WO2016/149795

PCT Pub. Date: Sep. 29, 2016

(65) Prior Publication Data

US 2018/0119491 A1 May 3, 2018

Related U.S. Application Data

(60) Provisional application No. 62/137,863, filed on Mar. 25, 2015.

(51) Int. Cl.
*E21B 4/10* (2006.01)

(52) U.S. Cl.
CPC ..... *E21B 4/10* (2013.01)

(58) Field of Classification Search
CPC ..... E21B 4/10; E21B 4/06; E21B 4/16; E21B 6/00; E21B 11/02

(Continued)

(56) References Cited

U.S. PATENT DOCUMENTS 1,845,074 A * 2/1932 Billstrom ..... E21B 4/10 175/298
2,146,454 A * 2/1939 Sutliff ..... E21B 4/10 175/298

(Continued)

OTHER PUBLICATIONS

International Search Report and Written Opinion dated Jun. 13, 2016, for International Application No. PCT/CA2016/000082 (8 pages).

*Primary Examiner* — Michael R Wills, III
(74) *Attorney, Agent, or Firm* — Conley Rose, P.C.

(57) ABSTRACT

A downhole motor has a bearing mandrel rotatably disposed within a housing, plus an impact adapter disposed above and connected to the bearing mandrel and rotatable therewith. The impact adapter has upwardly-projecting teeth engageable with downwardly-projecting teeth on a drive mandrel disposed above and coaxially aligned with the impact adapter. The drive mandrel is both rotatable and axially movable within the housing, and relative to the impact adapter. By means of a cam assembly and a helical spring (or other energy storage means) associated with the drive mandrel, rotation of the drive mandrel causes upward movement of the drive mandrel within the housing, thus compressing the spring. Further rotation causes instantaneous dropping of the drive mandrel, releasing energy stored in the spring, and causing the application of rotational and/or axial impacts to the bearing mandrel, and thus to a drill bit connected to the bearing mandrel.

16 Claims, 8 Drawing Sheets

(58) Field of Classification Search
USPC ..... 175/298, 305
See application file for complete search history.

(56) References Cited

U.S. PATENT DOCUMENTS

| | | | | | |
|---|---|---|---|---|---|
| 2,153,883 | A * | 4/1939 | Poster | E21B 4/10 | 173/205 |
| 2,495,364 | A | 1/1950 | Clapp | | |
| 2,742,264 | A | 4/1956 | Snyder | | |
| 3,132,707 | A * | 5/1964 | Ford | E21B 4/10 | 166/301 |
| 3,396,807 | A * | 8/1968 | Menton | E21B 4/10 | 175/293 |
| 4,359,109 | A | 11/1982 | Truong-Cao | | |
| 4,408,570 | A | 10/1983 | Schoeffler | | |
| 6,695,065 | B2 * | 2/2004 | Simpson | E21B 4/10 | 166/384 |
| 6,745,836 | B2 * | 6/2004 | Taylor | E21B 4/006 | 166/178 |
| 7,237,625 | B2 | 7/2007 | Minshull et al. | | |
| 8,783,354 | B2 * | 7/2014 | Sheehan | F16F 1/121 | 166/178 |
| 2013/0264119 | A1 * | 10/2013 | Gynz-Rekowski | E21B 10/36 | 175/57 |
| 2016/0108674 | A1 * | 4/2016 | von Gynz-Rekowski | E21B 1/00 | 175/57 |

* cited by examiner

IMPACT-DRIVEN DOWNHOLE MOTORS

CROSS-REFERENCE TO RELATED APPLICATIONS

This application is a 35 U.S.C. § 371 national stage application of PCT/CA2016/000082 filed Mar. 24, 2016, and entitled "Impact-Driven Downhole Motors," which claims benefit of U.S. application No. 62/137,863 filed on Mar. 25, 2015, both of which are incorporated herein by reference in their entirety for all purposes.

FIELD

The present disclosure relates in general to downhole motors used for drilling oil, gas, and water wells, and relates in particular to drive systems incorporated into such downhole motors.

BACKGROUND

In drilling a wellbore into the earth, such as for the recovery of hydrocarbons or minerals from a subsurface formation, it is conventional practice to connect a drill bit to the lower end of an assembly of drill pipe sections connected end-to-end (commonly referred to as a "drill string"), and then to rotate the drill string so that the drill bit progresses downward into the earth to create the desired wellbore. In conventional vertical wellbore drilling operations, the drill string and bit are rotated by means of either a "rotary table" or a "top drive" associated with a drilling rig erected at the ground surface over the wellbore (or, in offshore drilling operations, on a seabed-supported drilling platform or a suitably adapted floating vessel).

During the drilling process, a drilling fluid (also called "drilling mud", or simply "mud") is pumped under pressure downward through the drill string, out the drill bit into the wellbore, and then upward back to the surface through the annular space between the drill string and the wellbore. The drilling fluid, which may be water-based or oil-based, carries wellbore cuttings to the surface, but can also perform other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the wellbore wall (to stabilize and seal the wellbore wall).

Particularly since the mid-1980s, it has become increasingly common and desirable in the oil and gas industry to use "directional drilling" techniques to drill horizontal and other non-vertical wellbores, to facilitate more efficient access to and production from larger regions of subsurface hydrocarbon-bearing formations than would be possible using only vertical wellbores. In directional drilling, specialized drill string components and "bottomhole assemblies" (BHAs) are used to induce, monitor, and control deviations in the path of the drill bit, so as to produce a wellbore of desired non-vertical configuration.

Directional drilling is typically carried out using a downhole motor (also called a "drilling motor" or "mud motor") incorporated into the drill string immediately above the drill bit. A typical downhole motor assembly includes the following primary components (listed in sequence, from the top of the motor assembly):

- a top sub adapted to facilitate connection to the lower end of a drill string ("sub" being the common general term in the oil and gas industry for any small or secondary drill string component);

- a power section operably connected to the top sub;
- a drive shaft housing (which may be straight, bent, or incrementally adjustable between zero degrees and a maximum angle);
- a drive shaft enclosed within the drive shaft housing, with the upper end of the drive shaft being operably connected to the power section; and
- a bearing section comprising a bearing mandrel coaxially and rotatably disposed within a bearing mandrel housing, with an upper end coupled to the lower end of the drive shaft, and a lower end adapted for connection to a drill bit.

The bearing mandrel is rotated by the drive shaft, which rotates in response to the flow of drilling fluid under pressure through the power section. The bearing mandrel rotates relative to the bearing mandrel housing, which is connected to the drill string (via the drive shaft housing and other housing sections forming part of the BHA) such that the bearing mandrel housing rotates with the drill string.

Conventional downhole motor assemblies commonly include power sections incorporating either a "Moineau" drive system (i.e., a progressive cavity motor, comprising a positive displacement motor of well-known type, with a helically-vaned rotor eccentrically rotatable within a stator section) or a turbine-type drive system.

In one operational mode, a downhole motor may rotate the bit without concurrent rotation of the drill string; this is referred to as "slide drilling". In another operational mode, the downhole motor may rotate the bit relative to the drill string in conjunction with rotation of the drill string by a top drive or rotary table.

In recent years, the available torque output of downhole motor power sections has continued to increase due to improved technologies and manufacturing capabilities, and is outpacing the torsional capacity of downhole motors. This trend appears likely to continue as increasingly higher torques are required for drilling through hard subsurface formation materials.

Such high torque requirements are straining the capabilities of conventional downhole motors, causing premature failures and unfavorable drilling conditions such as "stick slip" and "BHA whirl" (terms that will be familiar to persons skilled in the art). Due to the design characteristics of conventional drilling tools, increased reactive torque loads are being transferred through the drill string components, resulting in back-offs and fatigue failures.

For the foregoing reasons, there is a need for downhole motors that will allow the use of lower-torque conventional power sections to drill through hard subsurface materials while reducing the magnitude of reactive torque loads being transferred to the drill string.

BRIEF SUMMARY

In general terms, the present disclosure teaches embodiments of downhole motors in which intermittent rotational and/or axial impacts are applied to the bearing mandrel and, therefore, to the drill bit.

In a first embodiment of a downhole motor in accordance with this disclosure (which first embodiment will be referred to herein for convenience as an "impact driver motor"), the bearing mandrel is rotated relative to the other primary drill string components by the application of regular axial and rotational impacts to the bearing mandrel, so as to rotate the bearing mandrel and the drill bit relative to the drill string. The impact driver motor can be used either for slide drilling operations or in conjunction with rotation of the drill string.

A second embodiment of a downhole motor in accordance with this disclosure (which second embodiment will be referred to herein for convenience as a "torsional impact motor") is particularly intended for enhancing drilling effectiveness and efficiency by a higher frequency of axial impacts being applied to the bearing mandrel to enhance drilling effectiveness while continuously rotating the bit with the drive shaft assembly. In certain variants of the torsional impact motor, the impacts applied to the bearing mandrel may include a rotational (i.e., torque) component, inducing relative rotation between the bearing mandrel and the drill string.

Accordingly, the present disclosure teaches a downhole motor that includes:

- a bearing mandrel rotatably disposed within a housing;
- an impact adapter disposed above and connected to the bearing mandrel so as to be rotatable with the bearing mandrel, with the impact adapter having an upper end with upwardly-projecting impact adapter teeth;
- a drive mandrel disposed within the housing above and in coaxial alignment with the impact adapter, with the drive mandrel being both rotatable and axially movable relative both to the housing and the impact adapter, and with the drive mandrel having a lower end with downwardly-projecting drive mandrel teeth that are engageable with the impact adapter teeth;
- a cam apparatus associated with the drive mandrel; and
- kinetic energy storage means associated with the drive mandrel and the cam assembly.

This downhole motor and its components are configured such that:

- rotation of the drive mandrel (such as by the power section of the downhole motor) will cause axially-upward movement of the drive mandrel relative to the impact adapter and the housing, resulting in kinetic energy being stored in the kinetic energy storage means; and
- further rotation of the drive mandrel will cause axially-downward movement of the drive mandrel so as to release the kinetic energy stored in the kinetic energy storage means, such that the drive mandrel imparts axial impact forces to the bearing mandrel.

In alternative variants, the downhole motor may be configured such that both rotational and axial impact forces will be imparted to the bearing mandrel upon the release of kinetic energy stored in the kinetic energy storage means.

In one non-limiting variant of the downhole motor, the cam apparatus includes a cam ring that has a central opening, and the cam ring is mounted within the bore of the housing so as to be rotatable with the housing. The drive mandrel passes through the central opening in the cam ring such that the drive mandrel is axially movable relative to the cam ring and the cam ring is rotatable about the drive mandrel. A plurality of cam lobes are formed on an upper end of the cam ring, with uniform angular intervals between adjacent cam lobes. Each cam lobe has a cam profile that defines a lower flat section, which is contiguous with a ramp section, which is contiguous with an upper flat section, which is contiguous with an axial face, which is contiguous with the lower flat section of the next adjacent cam lobe.

The cam apparatus in this variant also includes a roller cage disposed above the cam ring and coaxial therewith. The roller cage is disposed around and fixed to drive mandrel such that the roller cage is rotatable with the drive mandrel. The roller cage includes a plurality of rollers corresponding to the cam lobes in terms of number and angular spacing, with the rollers being configured for rollable engagement with the cam profiles of the cam lobes.

The kinetic energy storage means may comprises a helical spring disposed within an annulus between the drive mandrel and the housing, with a lower end of the spring reacts against the roller cage and an upper end of the spring reacting against a shoulder formed in the bore of the housing. In alternative variants, the kinetic energy storage means may be provided in the form of a gas spring.

In some variants of the downhole motor, the impact adapter teeth and the drive mandrel teeth are completely disengaged when the drive mandrel is at its uppermost axial position. In other variants, the impact adapter teeth and the drive mandrel teeth are never completely disengaged.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Impact Driver Motor

FIGS. 1, 2A, 2B, and 3 illustrate an exemplary variant of an impact driver motor 100 in accordance with the present disclosure.

Figure 1:
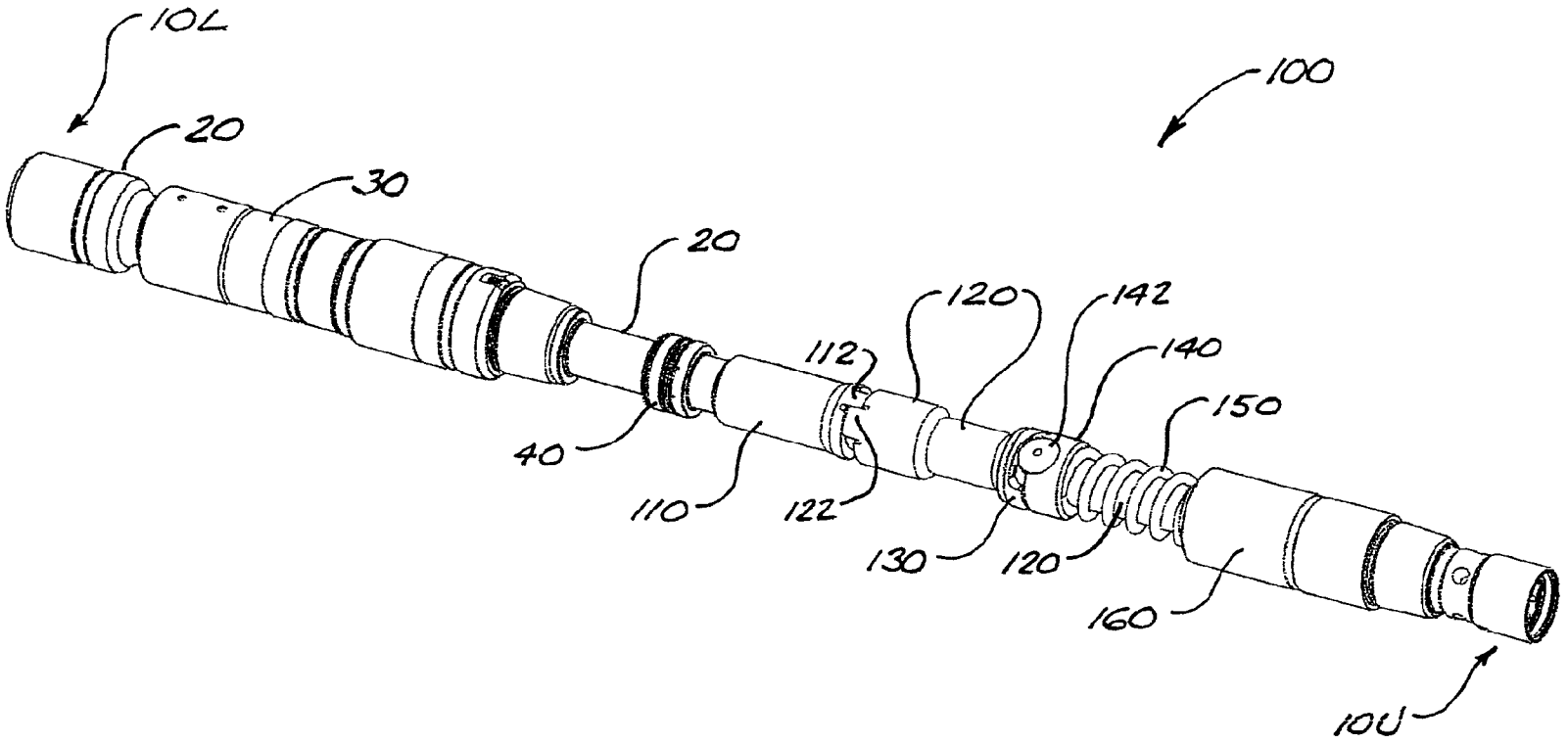
FIG. 1 is an isometric view of the impact mechanism of a first embodiment of a downhole motor assembly in accordance with the present disclosure, shown with portions of the motor assembly housing removed for illustration purposes.
Figure 3:
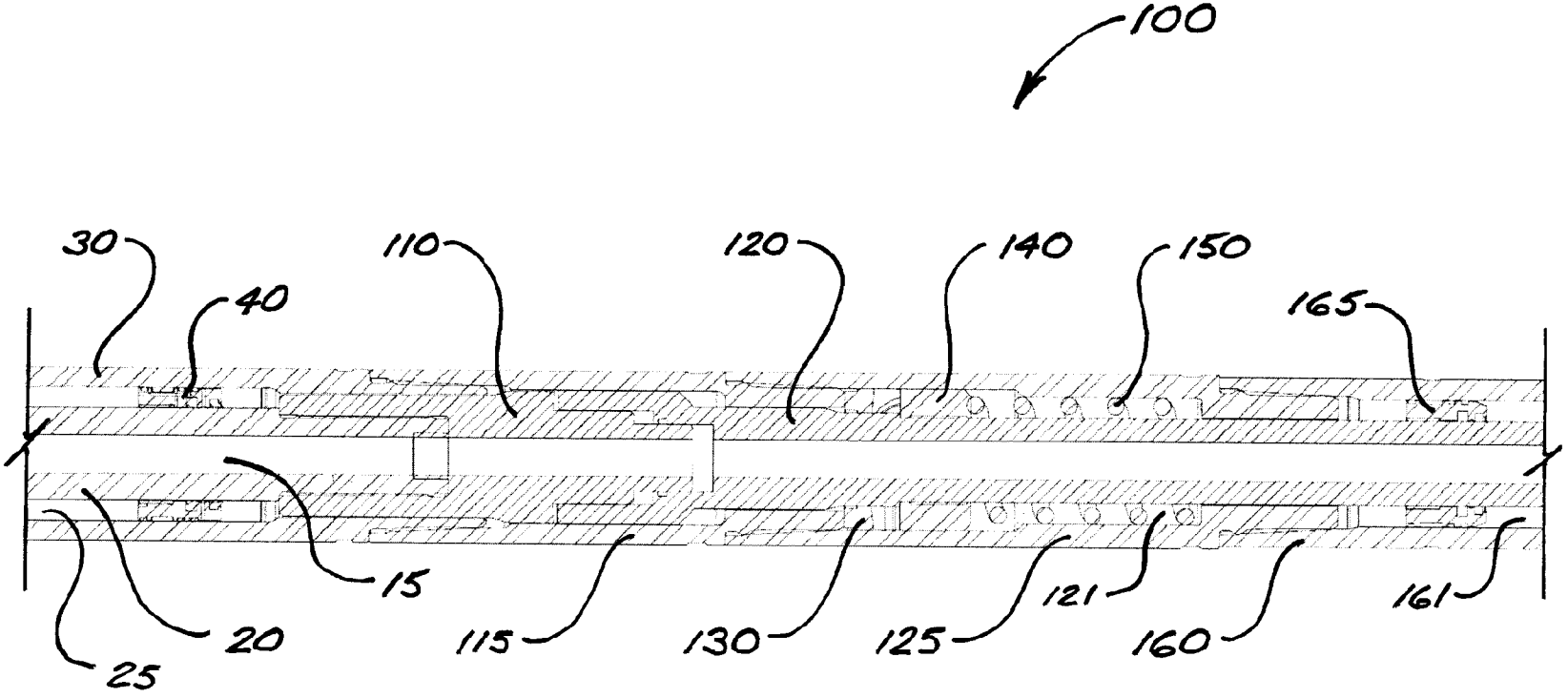
FIG. 3 is a longitudinal cross-section through the impact mechanism shown in FIGS. 1, 2A, and 2B.

Referring first to FIGS. 1 and 3, impact driver motor 100 includes a bearing mandrel 20 (having a lower end 10L adapted for connection to a drill bit), with an upper portion of bearing mandrel 20 being rotatably disposed within a bearing mandrel housing 30 (which forms part of the overall motor assembly housing, and only part of which is shown in FIG. 1). An upper end 10U of the assembly shown in FIG. 1 is adapted for connection to a downhole motor drive shaft (and an associated drive shaft housing). As shown in FIG. 3, bearing mandrel 20 has a central bore 15 through which drilling fluid can be pumped to the drill bit. Central bore 15 is in fluid communication with the drill string through contiguous bores or passages in other components of the motor assembly between bearing mandrel 20 and the drill string.

In the illustrated variant, a balancing piston 40 is disposed within an annulus 25 between bearing mandrel 20 and bearing mandrel housing 30 for prevention of differential pressure across a rotating seal between bearing mandrel 20 and bearing mandrel housing 30. However, this is by way of illustration only; the above-described function of piston 40 could be accomplished by other means known to persons skilled in the art, and piston 40 or functionally-equivalent means are not essential elements of the broadest embodiments within the scope of this disclosure.

As best appreciated with reference to FIG. 3, the upper end of bearing mandrel 20 is connected to the lower end of an impact adapter so as to be rotatable therewith. For purposes of describing the impact driver motor illustrated in FIGS. 1, 2A, 2B, and 3, this impact adapter will be referred to as anvil adapter 110, to distinguish it from the impact adapter of the torsional impact motor described further on in this disclosure and illustrated in FIGS. 4 5A, 5B, and 6.

Anvil adapter 110 is rotatable within an anvil adapter housing 115 (which forms part of the overall motor assembly housing, and is shown only in FIG. 3) which is connected to bearing mandrel housing 30 so as to be rotatable therewith. A plurality of anvil adapter teeth 112 project axially upward from the upper end of anvil adapter 110 at equal angular intervals around the perimeter of anvil adapter 110. In the illustrated variant, anvil adapter 110 has two anvil adapter teeth 112 at 180° spacing; however, the number of anvil adapter teeth 112 could be higher in alternative variants without departing from the scope of the present disclosure.

Figure 2A:
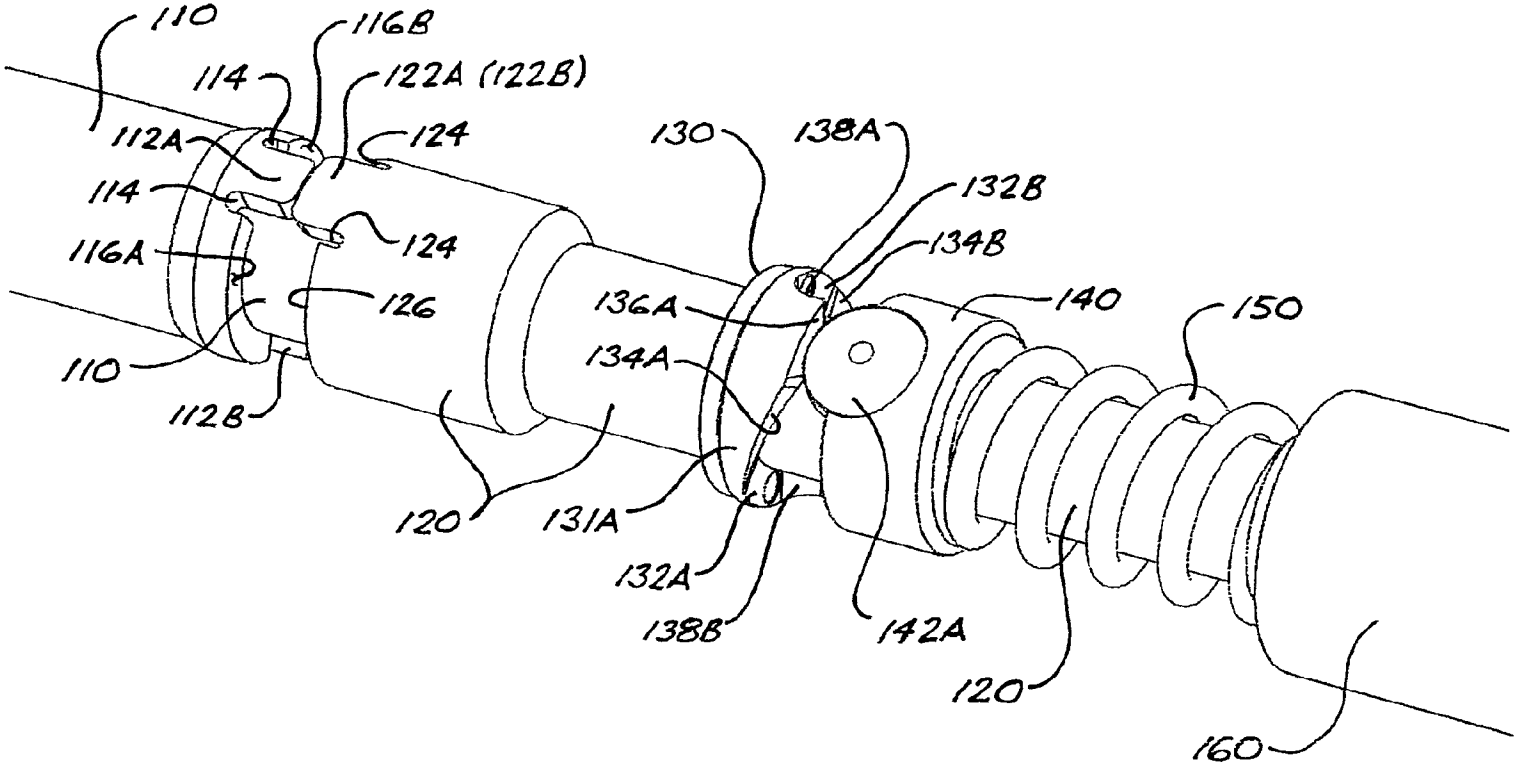
FIG. 2A is an enlarged isometric detail of the impact mechanism shown in FIG. 1, illustrating the anvil adapter and the hammer mandrel of the impact mechanism in a first operational position.
Figure 2B:
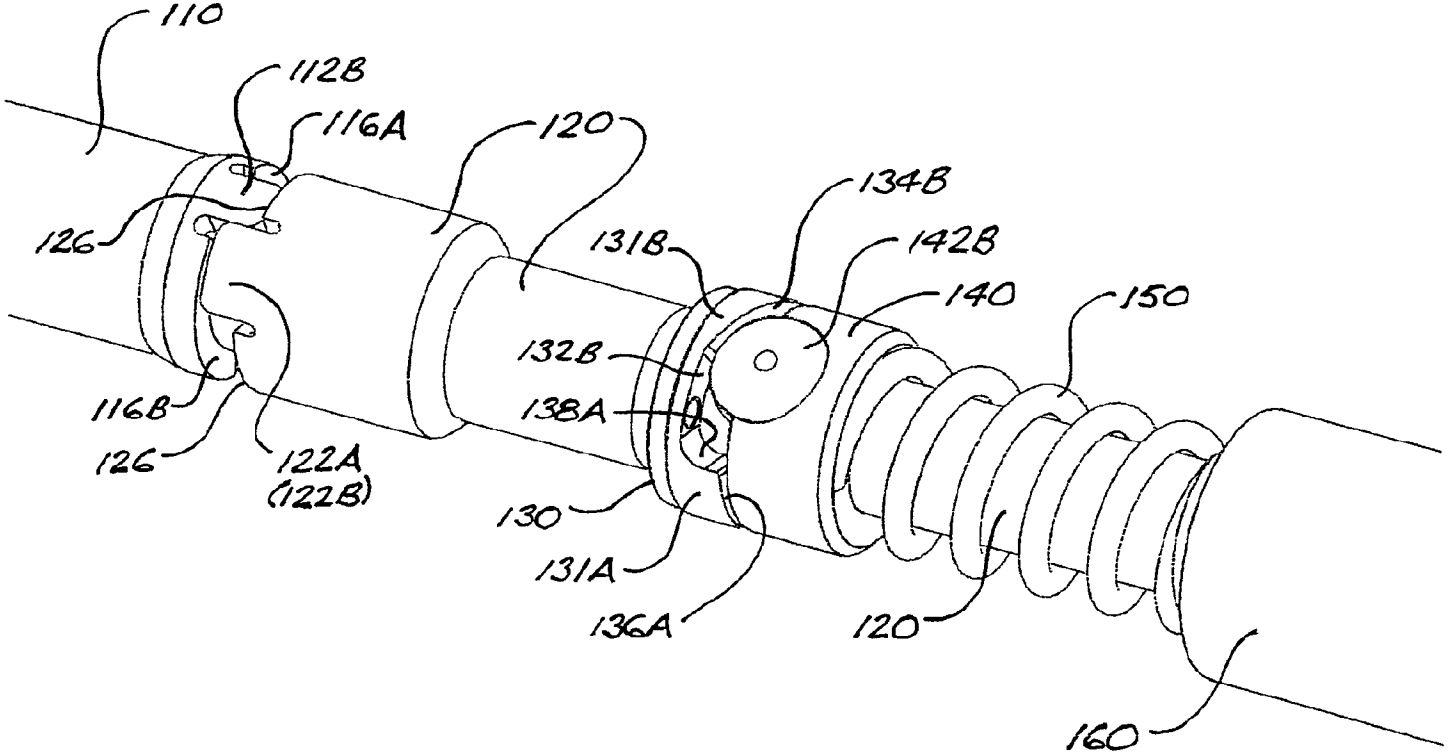
FIG. 2B is an enlarged isometric detail of the impact mechanism shown in FIG. 1, illustrating the anvil adapter and the hammer mandrel of the impact mechanism in a second operational position.

Although the two anvil adapter teeth in the illustrated variant are of essentially identical configuration, they are denoted in FIGS. 2A and 2B by reference numbers 112A and 112B for illustrative purposes. Annular shoulders 116 (or 116A and 116B in the illustrated embodiment, per FIGS. 2A and 2B) are formed between adjacent anvil adapter teeth (112A, 112B). Optionally, notches 114 may be provided at junctures of anvil adapter teeth 112 and shoulders 116, as shown by way of example in FIGS. 2A and 2B, to provide a lubricant flow path.

A drive mandrel is provided above and in coaxial alignment with anvil adapter 110. For purposes of describing the impact driver motor illustrated in FIGS. 1, 2A, 2B, and 3, this drive mandrel will be referred to as hammer mandrel 110, to distinguish it from the drive mandrel of the torsional impact motor described further on in this disclosure and illustrated in FIGS. 4 5A, 5B, and 6.

Hammer mandrel 120 is rotatable within a hammer mandrel housing 125 (which forms part of the overall motor assembly housing, and is shown only in FIG. 3), which is connected to anvil adapter housing 115 so as to be rotatable therewith. A plurality of hammer mandrel teeth 122 (corresponding to anvil adapter teeth 112 in number and angular spacing) project axially downward from the lower end of hammer mandrel 120.

Although the two hammer mandrel teeth in the illustrated variant are of essentially identical configuration, they are denoted in FIGS. 2A and 2B by reference numbers 122A and 122B for illustrative purposes. Annular shoulders 126 (or 126A and 126B in the illustrated embodiment, per FIGS. 2A and 2B) are formed between adjacent hammer mandrel teeth (122A, 122B). Optionally, notches 124 may be provided at junctures of hammer mandrel teeth 122 and shoulders 126, as shown by way of example in FIGS. 2A and 2B, to provide a lubricant flow path. Hammer mandrel 120 is axially movable within hammer mandrel housing 125 such that it can stroke axially relative to anvil adapter 110.

An upper cylindrical portion of hammer mandrel 120 passes through and is axially movable relative to a cam ring 130, which is mounted within the bore of the motor assembly housing so as to be rotatable therewith; hammer mandrel 120 therefore is rotatable relative to cam ring 130. The upper end of cam ring 130 is formed with a plurality of cam lobes 131 (corresponding to teeth 112 and 122 in number and angular spacing). In the illustrated variant, cam ring 130 has two cam lobes, which although of essentially identical configuration are denoted in FIGS. 2A and 2B by reference numbers 131A and 131B for illustrative purposes. Each cam lobe (131A, 131B) in the illustrated variant has a cam profile defining a lower flat section (132A, 132B), which is contiguous with a ramp section (134A, 134B), which is contiguous with an upper flat section (136A, 136B), which is contiguous with an axial face (138A, 138B), which is contiguous with the lower flat section (132B or 132A) of the other cam lobe (131B or 131A).

Above cam ring 130, a roller cage 140 is coaxially disposed around and fixed to hammer mandrel 120 so as to be rotatable therewith. Roller cage 140 includes a plurality of rollers 142 corresponding to cam lobes 131 in number and angular spacing, and configured for rollable engagement with the cam profiles of cam lobes 131. In the illustrated variant, roller cage 140 has two rollers, which although of essentially identical configuration are denoted in FIGS. 2A and 2B by reference numbers 142A and 142B for illustrative purposes.

Above roller cage 140, hammer mandrel 120 passes through a helical spring 150 disposed within an annulus 121 between hammer mandrel 120 and hammer mandrel housing 125. As best seen in FIG. 3, spring 150 bears at its lower end against roller cage 140 and at its upper end against a shoulder formed in the bore of hammer mandrel housing 125. Annulus 121 will preferably be filled with a suitable oil.

As best seen in FIG. 3, the upper end of hammer mandrel housing 125 connects to a piston housing 160, and the upper end of hammer mandrel 120 extends into piston housing 160 and then is operably connected to the power section (not shown) of the downhole motor assembly. In the illustrated variant, an annulus 161 between hammer mandrel 120 and piston housing 160 is also filled with a suitable oil, and a balancing piston 165 is disposed in annulus 161 to provide hydraulic pressure balancing during operation of impact driver motor 100.

The operation of impact driver motor 100 can be best understood with reference to FIGS. 2A and 2B. The rotation of hammer mandrel 120 (by the power section of the downhole motor) causes rollers 142A and 142B to travel along the cam profiles of cam ring 130. Because cam ring 130 is fixed relative to the housing assembly, roller cage 140 and hammer mandrel 120 are drawn upward within hammer mandrel housing 125 as the rollers (142A, 142B) move up the cam ramp sections (134A, 134B) onto the upper flat sections (136A, 136B) of the cam profile as shown in FIG. 2A, completely disengaging hammer mandrel 120 from anvil adapter 110, and axially compressing helical spring 150, resulting in kinetic energy being stored therein. At this point, hammer mandrel 120 does not transfer any torque to the bit (via anvil adapter 110), as the bit is not rotating at this point. The additional power section pressure required to turn the rollers 142 up the cam ramp sections 134 can now be fully released, as no drilling loads are acting on the power section.

As rotation of hammer mandrel 120 continues, and as seen in FIG. 2B, the rollers (142A, 142B) drop off the upper flat sections that they had been on (i.e., 136A, 136B, as seen in FIG. 2A), and onto the adjacent lower flat sections (132B, 132A). This causes instantaneous release of the stored energy in spring 150 such that hammer mandrel 120 strokes downward and imparts an axial impact force against anvil adapter 110 (by way of either axial impact of hammer mandrel teeth 122A, 122B against annular shoulders 116A, 116B on anvil adapter 110, or axial impact of annular shoulders 126A, 126B on hammer mandrel 120 against anvil adapter teeth 112A, 112B), which in turn transfers the axial impact force to the drill bit via bearing mandrel 20. The axial impact force from the stored energy in spring 150 is augmented by additional stored energy in the mass of the drive shaft and the power section rotor above hammer mandrel 120, which additional energy is released concurrently with the energy in spring 150.

Due to the continuing rotation of hammer mandrel 120, the side faces of the hammer mandrel teeth (122A, 122B) also impart lateral impact forces against the side faces of the next-adjacent anvil adapter teeth (i.e., 112B and 112A) as seen in FIG. 2B, thus incrementally rotating anvil mandrel 110, bearing mandrel 20, and the drill bit relative to the drill string.

As rotation of the drive shaft (not shown) continues, the rollers (142A, 142B) again move up the cam ramp sections 132, as shown in FIG. 2B, raising hammer mandrel 120 so as to fully disengage the hammer mandrel teeth (122A, 122B) from anvil adapter 110 and again compressing spring 150, with the axial loads on the rotor, the drive shaft, and hammer mandrel 120 being reacted through cam ring 130 to the motor assembly housing.

This application of regular impact forces to anvil adapter 110 occurs continuously as the drive shaft and hammer mandrel 120 rotate, with the number of impacts per rotation equaling the number of anvil adapter teeth 112 (and hammer mandrel teeth 122 and cam lobes 131). For each full rotation of the rotor, the bit will only rotate a percentage of a turn, and this will lessen the reactive torque transferred to the drill string.

Torsional Impact Motor

FIGS. 4, 5A, 5B, and 6 illustrate an exemplary variant of a "torsional impact motor" in accordance with the present disclosure.

Figure 4:
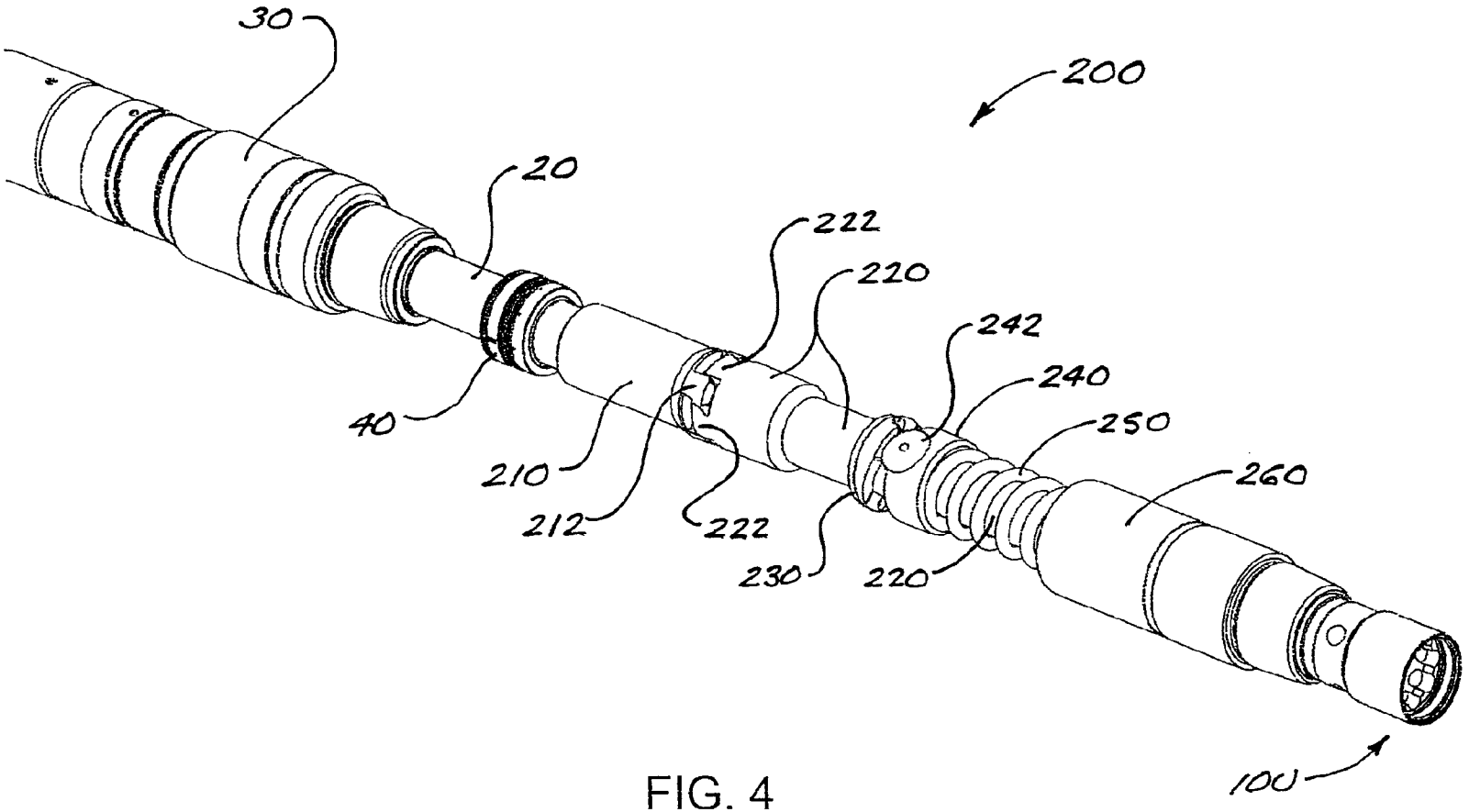
FIG. 4 is an isometric view of the impact mechanism of a second embodiment of a downhole motor assembly in accordance with the present disclosure, shown with portions of the motor assembly housing removed for illustration purposes.
Figure 6:
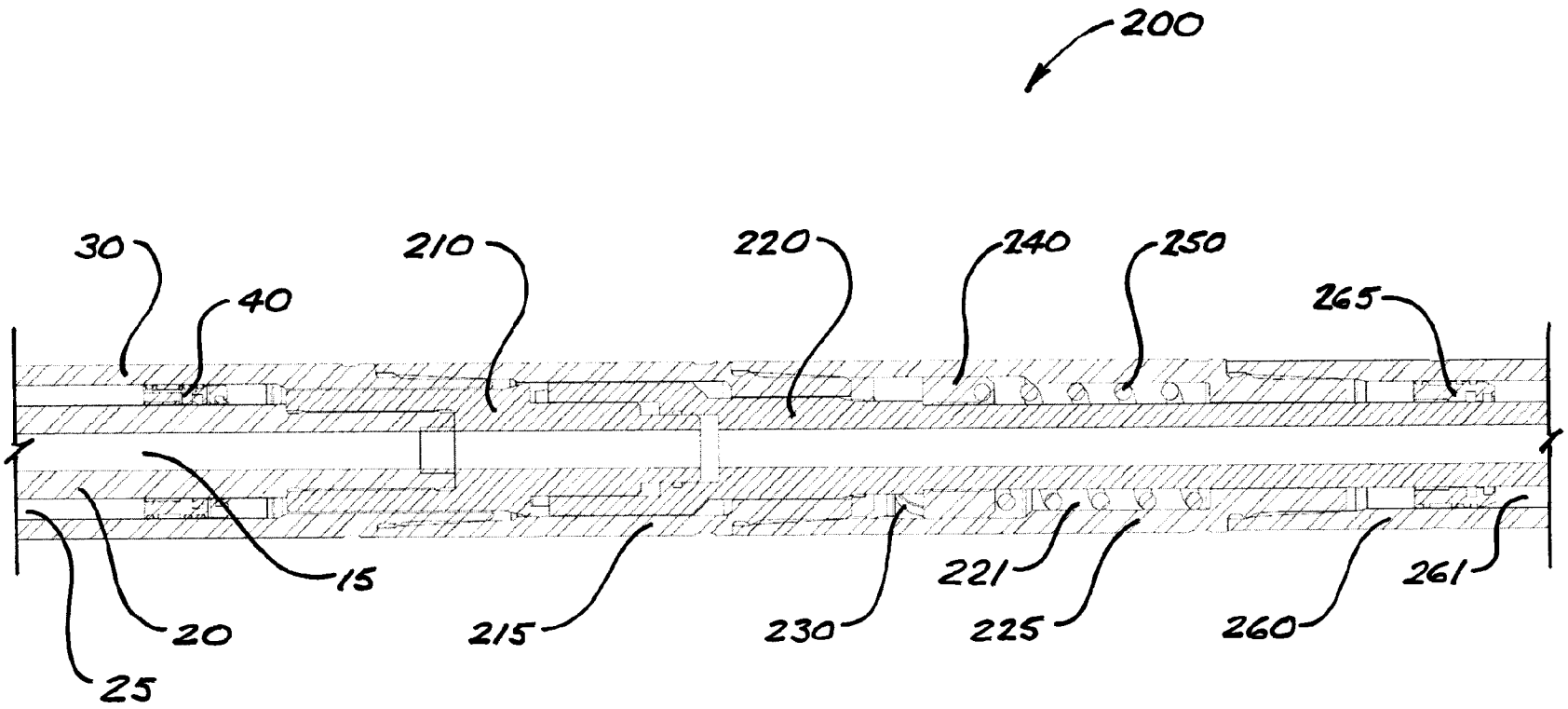
FIG. 6 is a longitudinal cross-section through the impact mechanism shown in FIGS. 4, 5A, and 5B.

Referring first to FIGS. 4 and 6, torsional impact motor 200 includes a bearing mandrel 20 having a lower end (not shown) adapted for connection to a drill bit, with an upper portion of bearing mandrel 20 being rotatably disposed within a bearing mandrel housing 30 (only part of which is shown in FIG. 4). An upper end 10U of the assembly shown in FIG. 4 is adapted for connection to a downhole motor drive shaft (and drive shaft housing). As shown in FIG. 6, bearing mandrel 20 has a central bore 15 through which drilling fluid can be pumped to the drill bit. Central bore 15 is in fluid communication with the drill string through contiguous bores or passages in other components of the motor assembly between bearing mandrel 20 and the drill string. In the illustrated variant, a balancing piston 40 is disposed within an annulus 25 between bearing mandrel 20 and bearing mandrel housing 30.

As best appreciated with reference to FIG. 6, the upper end of bearing mandrel 20 is connected to the lower end of an impact adapter 210 so as to be rotatable therewith. Impact adapter 210 is rotatable within an impact adapter housing 215 (shown only in FIG. 6) which is connected to bearing mandrel housing 30 so as to be rotatable therewith. A plurality of impact adapter teeth 212 project axially upward from the upper end of impact adapter 210 at equal angular intervals around the perimeter of impact adapter 210. In the illustrated variant, impact adapter 210 has four impact adapter teeth 212 at 90° spacing; however, the number of impact adapter teeth 212 could be higher or lower in alternative variants without departing from the scope of the present disclosure. Although the four impact adapter teeth in the illustrated variant are of essentially identical configuration, they are denoted in FIGS. 5A and 5B by reference numbers 212A and 212B for illustrative purposes.

A drive mandrel 220 is provided above and in coaxial alignment with impact adapter 210. Drive mandrel 220 is rotatable within a drive mandrel housing 225 (shown only in FIG. 6), which is connected to impact adapter housing 215 so as to be rotatable therewith. A plurality of drive mandrel teeth 222 (corresponding to impact adapter teeth 212 in number and angular spacing) project axially downward from the lower end of drive mandrel 220.

Figure 5A:
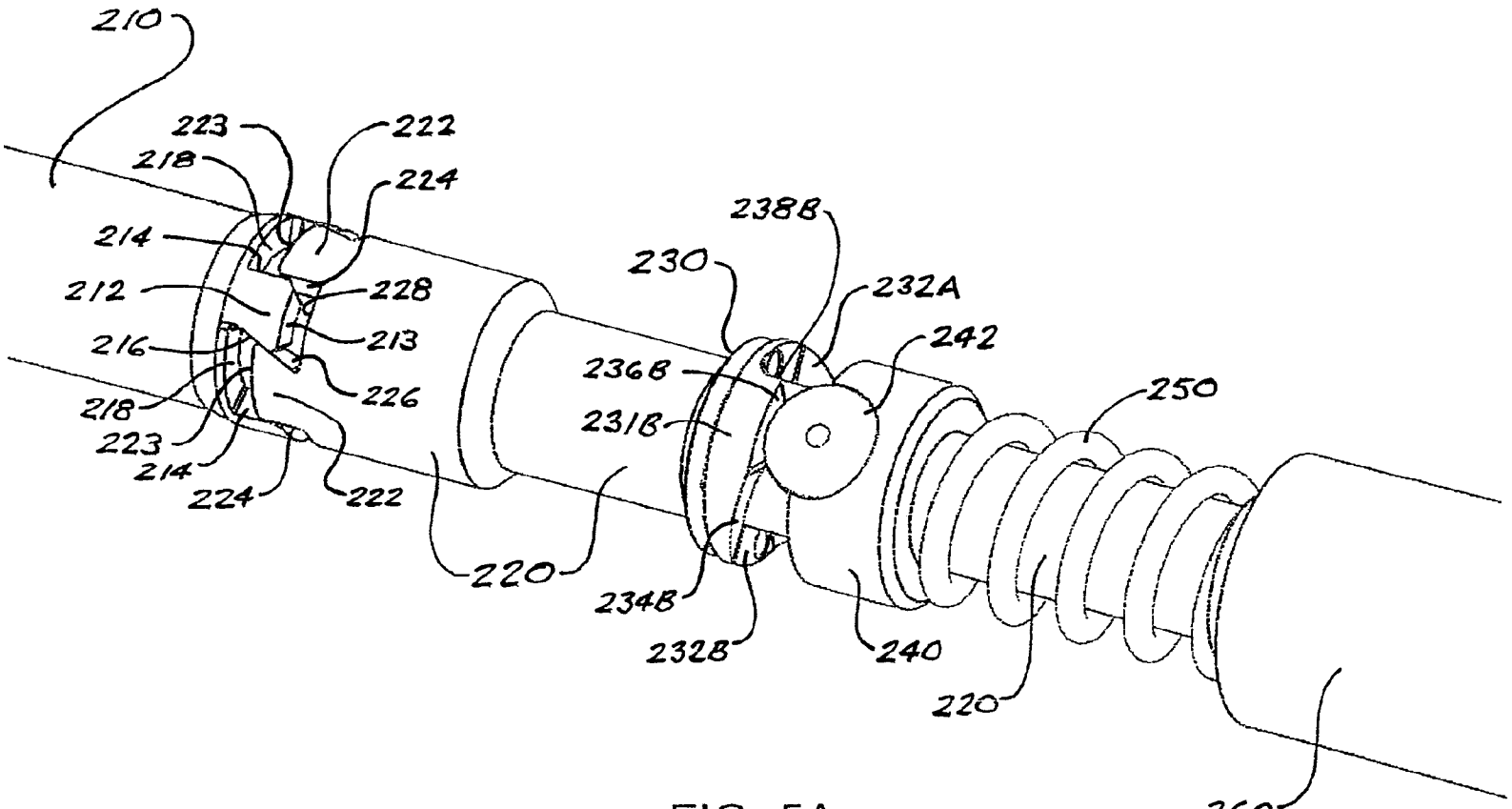
FIG. 5A is an enlarged isometric detail of the impact mechanism shown in FIG. 4, illustrating the impact adapter and the drive mandrel of the impact mechanism in a first operational position.

As seen in greater detail in FIG. 5A, each impact adapter tooth 212 in the illustrated variant has an upper end face 213 extending between an axial side face 214 and an angled side face 216, creating an annular shoulder 218 on the upper end of impact adapter 210 between the roots of each pair of adjacent teeth 212. Each drive mandrel tooth 222 has a lower end face 225 extending between an axial side face 224 and an angled side face 226, creating an annular shoulder 228 on the lower end of drive mandrel 220 between the roots of each pair of adjacent teeth 222.

Figure 5B:
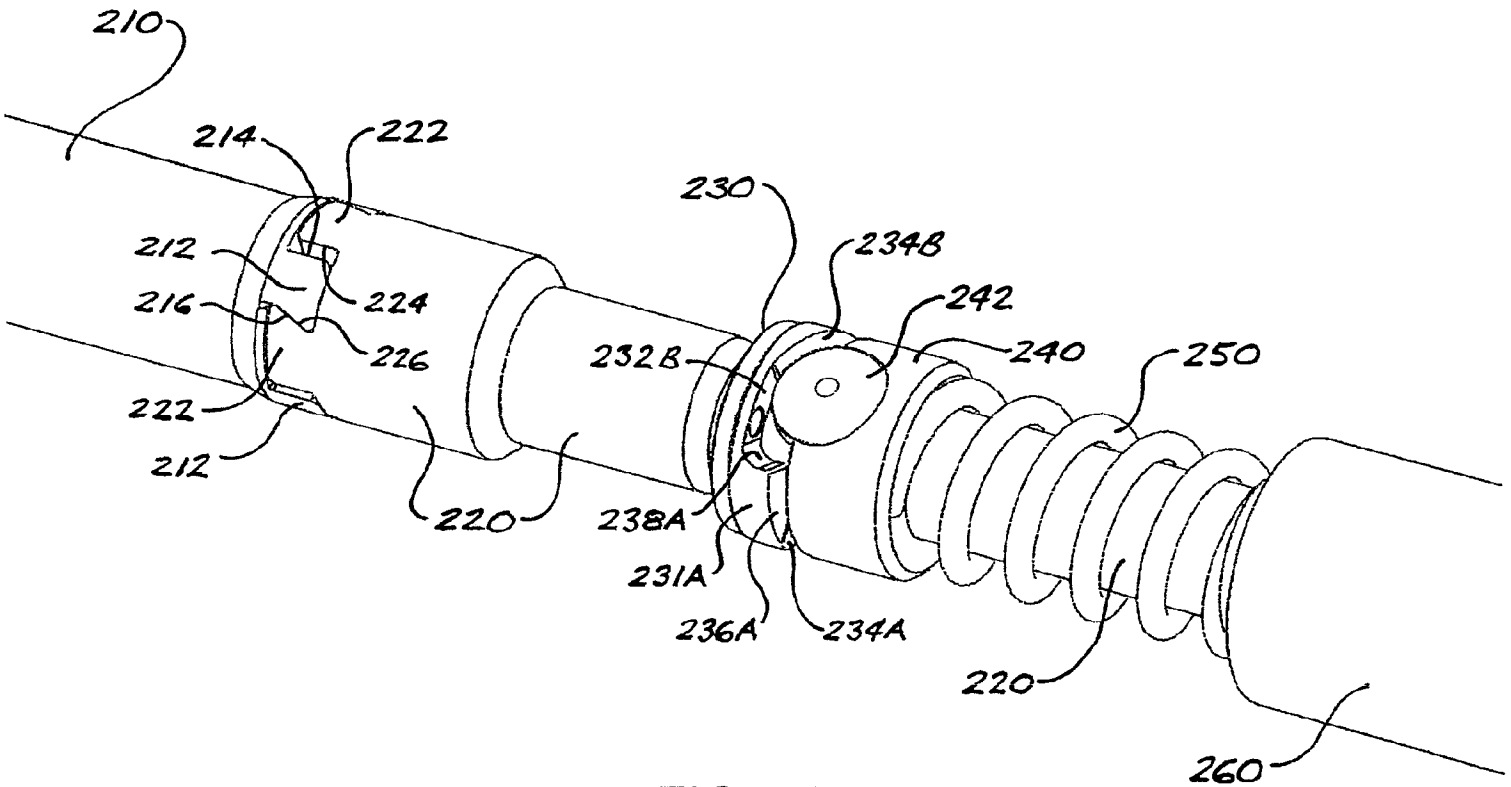
FIG. 5B is an enlarged isometric detail of the impact mechanism shown in FIG. 1, illustrating the impact adapter and the drive mandrel of the impact mechanism in a second operational position.

As seen in FIGS. 5A and 5B, drive mandrel 220 is assembled in engagement with impact adapter 210 such that the lower end face 225 of each drive mandrel tooth 222 faces the upper end face 213 of a corresponding impact adapter tooth 212, with the axial side face 224 of each drive mandrel tooth 222 being adjacent to and parallel to the axial side face 214 of the corresponding impact adapter tooth 212, and with the angled side face 226 of each drive mandrel tooth 222 being adjacent to and parallel to the angled side face 216 of the corresponding impact adapter tooth 212.

Drive mandrel 220 is axially movable within drive mandrel housing 225 such that it can stroke axially relative to impact adapter 210. However, the assembly is configured such that drive mandrel 220 is never completely disengaged from impact adapter 210, and relative rotational movement between drive mandrel 220 and impact adapter 210 is limited to the angular twist between impact adapter teeth 212 and drive mandrel teeth 222.

An upper cylindrical portion of drive mandrel 220 passes through and is axially movable relative to a cam ring 230 which is mounted within the bore of the motor assembly housing so as to be rotatable therewith; drive mandrel 220 therefore is rotatable relative to cam ring 230. The upper end of cam ring 230 is formed with a plurality of cam lobes 231. In the illustrated variant, cam ring 230 has two cam lobes, which although of essentially identical configuration are denoted in FIGS. 5A and 5B by reference numbers 231A and 231B for illustrative purposes. Each cam lobe (231A, 231B) in the illustrated variant has a cam profile defining a lower flat section (232A, 232B), which is contiguous with a ramp section (234A, 234B), which is contiguous with an upper flat section (236A, 236B), which is contiguous with an axial face (238A, 238B), which is contiguous with the lower flat section (232B or 232A) of the other cam lobe (231B or 231A).

Above cam ring 230, a roller cage 240 is coaxially disposed around and fixed to drive mandrel 220 so as to be rotatable therewith. Roller cage 240 includes a plurality of rollers 242 corresponding to cam lobes 231 in number and angular spacing, and configured for rollable engagement with the cam profiles of cam lobes 231. In the illustrated variant, roller cage 240 has two rollers, which although of essentially identical configuration are denoted in FIGS. 5A and 5B by reference numbers 242A and 242B for illustrative purposes.

Above roller cage 240, drive mandrel 220 passes through a helical spring 250 disposed within an annulus 221 between drive mandrel 220 and drive mandrel housing 225. As best seen in FIG. 6, spring 250 bears at its lower end against roller cage 240 and at its upper end against a shoulder formed in the bore of drive mandrel housing 225. Annulus 221 will preferably be filled with a suitable oil.

As best seen in FIG. 6, the upper end of drive mandrel housing 225 connects to a piston housing 260, and the upper end of drive mandrel 220 extends into piston housing 260 and then is operably connected to the power section (not shown) of the downhole motor assembly. In a preferred variant, an annulus 261 between drive mandrel 220 and piston housing 260 is also filled with a suitable oil (not necessarily of the same type as the oil in annulus 221), and a pressure equalization piston 265 is disposed in annulus 261 to provide hydraulic pressure balancing during operation of torsional impact motor 200.

The operation of torsional impact motor 200 can be best understood with reference to FIGS. 5A and 5B. The rotation of drive mandrel 220 (by the power section of the downhole motor) causes rollers 242A and 242B to travel along the cam profiles of cam ring 230. Because cam ring 230 is fixed to drive mandrel housing 225, roller cage 240 and drive mandrel 220 are drawn upward within drive mandrel housing 225 as the rollers (242A, 242B) move up the cam ramp sections (234A, 234B) onto the upper flat sections (236A, 236B) of the cam profile as shown in FIG. 5A, and this in turn causes compression of helical spring 250, resulting in kinetic energy being stored therein.

As rotation of drive mandrel 220 continues, and as seen in FIG. 2B, the rollers (242A, 242B) drop off the upper flat sections that they had been on (i.e., 236A, 236B, as seen in FIG. 5A), and onto the adjacent lower flat sections (232B, 232A). This causes instantaneous release of the stored energy in spring 250 such that drive mandrel 220 strokes downward and imparts an axial impact force against impact adapter 210 (by way of either axial impact of lower end faces 223 of drive mandrel teeth 222 against annular shoulders 218 on impact adapter 210, or axial impact of annular shoulders 228 on drive mandrel 220 against upper end faces 213 on impact adapter teeth 212), which in turn transfers the axial impact force to the drill bit via bearing mandrel 20. The axial impact force from the stored energy in spring 250 is augmented by additional stored energy in the mass of the drive shaft and rotor above drive mandrel 220, which additional energy is released concurrently with the energy in spring 250.

At the same time, the angled side faces 226 of the drive mandrel teeth 222 impart lateral impact forces against the angled side faces 216 of the corresponding impact adapter teeth 212 as seen in FIG. 5A, thus incrementally rotating impact adapter 210, bearing mandrel 20, and the drill bit relative to the drill string. The magnitude of these lateral impact forces will be a function of the angle of angled side faces 216 and 226 (which is shown by way of non-limiting example in FIGS. 5A and 5B as approximately 15°).

This application of intermittent impact forces to impact adapter 210 occurs continuously as the power section and drive mandrel 220 rotate, with the number of impacts per rotation equaling the number of cam lobes 231.

Unlike the operation of impact driver motor 100, where the bit turns only when hammer mandrel 120 is engaged with anvil adapter 110, the operation of torsional impact motor 200 is characterized by constant rotation of the bit, but with the effectiveness of the bit being augmented by the application of axial and torsional impacts to increase the rate of penetration (ROP).

The imparting of axial and torsional impacts and the provision within the motor assembly of an oscillating internal mass (comprising, in the case of impact driver motor 100, hammer mandrel 120, the drive shaft, and the rotor; or, in the case of torsional impact motor 200, drive mandrel 220, the drive shaft, and the rotor) have an operational effect analogous to placing a vibration-inducing tool (or an additional vibrating-inducing tool) in the BHA very close to the bit.

It is to be understood that the scope of the claims appended hereto should not be limited by the preferred embodiments described and illustrated herein, but should be given the broadest interpretation consistent with the description as a whole. It is also to be understood that the substitution of a variant of a claimed element or feature, without any substantial resultant change in functionality, will not constitute a departure from the scope of the disclosure. By way of only one non-limiting example, variant embodiments within the scope of the present disclosure could incorporate alternative known means for storing kinetic energy in substitution for helical spring 150 (or 250), such as, for example, a gas spring, with annulus 121 (or 221) being made substantially gas-tight and filled with a compressible gas.

In this patent document, any form of the word "comprise" is to be understood in its non-limiting sense to mean that any element following such word is included, but elements not specifically mentioned are not excluded. A reference to an element by the indefinite article "a" does not exclude the possibility that more than one of the element is present, unless the context clearly requires that there be one and only one such element.

Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure. Relational or relative terms (including but not limited to "horizontal", "vertical", "parallel", and "perpendicular") are not intended to denote or require absolute mathematical or geometrical precision. Accordingly, such terms are to be understood as denoting or requiring substantial precision only (e.g., "substantially horizontal") unless the context clearly requires otherwise.

In this patent document, certain components of disclosed embodiments are described using adjectives such as "upper" and "lower". These adjectives are used to establish a convenient frame of reference to facilitate explanation and to enhance the reader's understanding of spatial relationships and relative locations of the various elements and features of the components in question. The use of these adjectives is not to be interpreted as implying that they will be strictly applicable in all practical applications and usages of downhole motor assemblies in accordance with the present disclosure, or that such motor assemblies must be used in spatial orientations that are consistent with the strict meanings of these adjectives. For example, motor assemblies in accordance with the present disclosure may be used in drilling horizontal or angularly-oriented wellbores. For greater certainty, therefore, the adjectives "upper" and "lower", when used herein with reference to disclosed motor assemblies and components thereof, should be understood in the sense of "toward the upper or lower end (as the case may be) of the drill string", regardless of what the actual spatial orientation of the motor assembly and the drill string might be in a given practical usage.

Wherever used in this document, the terms "typical" and "typically" are to be interpreted in the sense of representative or common usage or practice, and are not to be understood as implying invariability or essentiality.

What is claimed is:

1. A downhole motor comprising:

(a) a bearing mandrel rotatably disposed within a housing;

(b) an impact adapter disposed above and connected to the bearing mandrel so as to be rotatable therewith, said impact adapter having an upper end with upwardly-projecting impact adapter teeth;

(c) a drive mandrel disposed within the housing above and in coaxial alignment with the impact adapter, said drive mandrel being rotatable and axially movable relative to the housing and relative to the impact adapter, and said drive mandrel having a lower end with downward-projecting drive mandrel teeth engageable with the impact adapter teeth;

(d) a cam assembly apparatus associated with the drive mandrel; and (e) a kinetic energy storage member, said kinetic energy storage member being associated with the drive mandrel and the cam assembly;

wherein:

(f) rotation of the drive mandrel causes axially-upward movement of the drive mandrel relative to the impact adapter and the housing, resulting in kinetic energy being stored in the kinetic energy storage member; and (g) further rotation of the drive mandrel causes axially-downward movement of the drive mandrel so as to release the kinetic energy stored in the kinetic energy storage member, such that the drive mandrel imparts axial impact forces to the bearing mandrel.

2. The downhole motor of claim 1 wherein rotational impact forces will be imparted to the bearing mandrel upon the release of kinetic energy stored in the kinetic energy storage member.

3. The downhole motor of claim 1 wherein the cam assembly comprises:

(a) a cam ring having a central opening and being mounted within the bore of the housing so as to be rotatable therewith, wherein:

the drive mandrel passes through said central opening in the cam ring such that the drive mandrel is axially movable relative to the cam ring and the cam ring is rotatable about the drive mandrel;

an upper end of the cam ring is formed with a plurality of cam lobes, with uniform angular spacing between adjacent cam lobes; and each cam lobe has a cam profile defining a lower flat section, which is contiguous with a ramp section, which is contiguous with an upper flat section, which is contiguous with an axial face, which is contiguous with the lower flat section of the next adjacent cam lobe; and (b) a roller cage disposed above the cam ring and coaxial therewith, and also disposed around and fixed to drive mandrel so as to be rotatable therewith, wherein:

the roller cage includes a plurality of rollers corresponding to cam lobes in number and angular spacing, and configured for rollable engagement with the cam profiles of the cam lobes.

4. The downhole motor of claim 1 wherein the kinetic energy storage member comprises a helical spring disposed within an annulus between the drive mandrel and the housing.

5. The downhole motor as in claim 3 wherein the kinetic energy storage member comprises a helical spring disposed within an annulus between the drive mandrel and the housing, wherein a lower end of the spring reacts against the roller cage and an upper end of the spring reacts against a shoulder formed in the bore of the housing.

6. The downhole motor of claim 1 wherein the kinetic energy storage member is provided in the form of a gas spring.

7. The downhole motor of claim 1 wherein:

(a) each impact adapter tooth has an upper end face extending between an axial side face and an angled side face so as to create an annular shoulder on the upper end of the impact adapter between the roots of each pair of adjacent impact adapter teeth; and (b) each drive mandrel tooth has a lower end face extending between an axial side face and an angled side face so as to create an annular shoulder on the lower end of drive mandrel between the roots of each pair of adjacent teeth.

8. The downhole motor of claim 7 wherein each drive mandrel tooth faces the upper end face of a corresponding impact adapter tooth, with the axial side face of each drive mandrel tooth being adjacent to and parallel to the axial side face of the corresponding impact adapter tooth, and with the angled side face of each drive mandrel tooth being adjacent to and parallel to the angled side face of the corresponding impact adapter tooth.

9. The downhole motor of claim 1 wherein the impact adapter teeth and the drive mandrel teeth are completely disengaged when the drive mandrel is at its uppermost axial position.

10. A downhole motor, comprising: an impact adapter coupled to a bearing mandrel, wherein the impact adapter comprises at least one tooth extending from an end of the impact adapter; a drive mandrel coupled to the downhole motor, wherein the drive mandrel comprises at least one tooth extending from an end of the drive mandrel; a cam ring coupled to an housing, wherein the cam ring comprises at least one cam lobe; a roller cage coupled to the drive mandrel, wherein the roller cage comprises at least one roller configured to travel along the at least one cam lobe of the cam ring; and a spring disposed about the drive mandrel, wherein the spring is configured to force engagement between the roller cage and the cam ring to cause relative axial movement between the impact adapter and the drive mandrel.

11. The downhole motor of claim 10, wherein:

when the drive mandrel is in a first position relative to the impact adapter, the drive mandrel is prevented from transferring torque to the impact adapter; and when the drive mandrel is in a second position relative to the impact adapter that is axially spaced from the first position, the drive mandrel is permitted to transfer torque to the impact adapter.

12. The downhole motor of claim 11, wherein:

a notch extends into the end of the impact adapter, wherein the notch is disposed between the at least one tooth of the impact adapter and an annular shoulder of the impact adapter; and a notch extends into the end of the drive mandrel, wherein the notch is disposed between the at least one tooth of the drive mandrel and an annular shoulder of the drive mandrel.

13. The downhole motor of claim 11, wherein, when the drive mandrel is in the first position, the at least one tooth of the impact mandrel does not axially overlap with the at least one tooth of the drive mandrel.

14. The downhole motor of claim 10, wherein:

when the drive mandrel is in a first axial position relative to the impact adapter, the drive mandrel is permitted to transfer torque to the impact adapter; and when the drive mandrel is in a second axial position relative to the impact adapter that is spaced from the first axial position, the drive mandrel is permitted to transfer torque to the impact adapter.

15. The downhole motor of claim 14, wherein the at least one tooth of the drive mandrel axially overlaps the at least one tooth of the impact mandrel when the drive mandrel is in both the first position and the second position.

16. The downhole motor of claim 14, wherein the at least one tooth of the drive mandrel comprises an angled side face configured to matingly engage an angled side face of the at least one tooth of the impact adapter.

* * * * *